United States Patent [19]

Busch

[11] Patent Number: 4,910,874

[45] Date of Patent: Mar. 27, 1990

[54] ARCHERY BOW SIGHT WITH GANGED LATERAL PIN MOVEMENT

[76] Inventor: Jeffery A. Busch, 110½ Freeborn St., Cecil, Wis. 54111

[21] Appl. No.: 363,472

[22] Filed: Jun. 8, 1989

[51] Int. Cl.[4] ..... F41G 1/46

[52] U.S. Cl. ..... 33/265; 124/87

[58] Field of Search ..... 33/265; 124/87

[56] References Cited

U.S. PATENT DOCUMENTS

| | | | |
|---|---|---|---|
| 2,574,599 | 11/1951 | Stieber . | |
| 3,063,151 | 11/1962 | Hanson | 33/265 |
| 3,234,651 | 2/1966 | Rivers . | |
| 3,271,863 | 9/1966 | Harrington | 33/265 |
| 3,320,670 | 5/1967 | Ambraziatis . | |
| 4,026,032 | 5/1977 | Smith . | |
| 4,162,579 | 7/1979 | James . | |
| 4,385,448 | 5/1983 | Burkey . | |
| 4,535,747 | 8/1985 | Kudlacek . | |
| 4,625,421 | 12/1986 | Strauss . | |
| 4,689,887 | 9/1987 | Colvin . | |
| 4,757,614 | 7/1988 | Kudlacek . | |

*Primary Examiner*—Harry N. Haroian

*Attorney, Agent, or Firm*—Fuller, Ryan & Hohenfeldt

[57] ABSTRACT

An archery bow sight mechanism for mounting to a bow stock, including a vertical base plate for connection to the bow stock. A pair of slider bars, or a single U-shaped slider having two legs, are affixed to the upper and lower ends of the base plate. A pin holder is provided, each end of which is slidably mounted to a respective one of the slider bars or legs. A plurality of sight pins are movably connected to the pin holder. A threaded lateral adjustment rod is affixed to the pin holder, and projects through the base plate. An adjustment knob is rotatably secured with respect to the base plate and threaded onto the lateral adjustment rod, such that the rod is moved laterally with respect to the bow stock by turning the knob on the lateral adjustment rod. Hence by turning the knob, the pins are moved laterally with respect to the bow stock, but are not moved at all with respect to each other. The pin holder is biased away from the base plate by a coil spring encircling the lateral adjustment rod between the pin holder and the base plate.

18 Claims, 2 Drawing Sheets

ARCHERY BOW SIGHT WITH GANGED LATERAL PIN MOVEMENT

BACKGROUND OF THE INVENTION

This invention relates to sights for attachment to hunting and target bows, and in particular to such a bow sight that permits ganged lateral movement of the sight pins of the sight.

Archery bow sights having a number of sight pins, permitting the archer to easily sight a target at a number of different distances, are well known. For instance, such a sight is disclosed in Smith, U.S. Pat. No. 4,026,032. In that patent, the sight pins are adjustable as a group vertically, for distance adjustments, and each sight pin is individually adjustable horizontally, for "windage", that is, to allow for cross-travel due to a wind directed at an angle transverse to the shot.

According to Strauss, U.S. Pat. No. 4,625,421, no sighting devices known up to that time permitted the archer three complete degrees of freedom of movement of the sight pins without disturbing the relative positioning of the pins with respect to each other. The sight disclosed in that patent does indeed permit lateral movement of all sight pins together. However, that sight permits only gross lateral movement of the pins, with no fine adjustment, such as by use of a screw arrangement as that design does permit in the other two directions.

This invention relates to improvements to the apparatus described above and to solutions to the problems raised thereby.

SUMMARY OF THE INVENTION

The invention relates to an archery bow sight mechanism for mounting to a bow stock. The bow sight includes base means for connection to the bow stock. The base means will be substantially vertically oriented, thus having an upper end and a lower end. The sight further includes a pair of slider bars, or a single U-shaped slider having two legs, affixed to the upper and lower ends of the base means. Pin holding means are provided, having two ends, each end slidably mounted to a respective one of the slider bars or legs. A plurality of sight pins are movably connected to the pin holding means. A threaded lateral adjustment rod is affixed to the pin holding means, and projects through the base means. A nut is rotatably secured with respect to the base means and threaded onto the lateral adjustment rod, such that the rod is moved laterally with respect to the bow stock by turning the nut on the lateral adjustment rod. Hence by turning the nut, the pins are moved laterally with respect to the bow stock, but are not moved at all with respect to each other. The pin holding means is biased away from the base means by biasing means such as a coil spring encircling the lateral adjustment rod between the pin holding means and the base means. The pin holding means includes a substantially vertical support frame, a threaded member substantially vertically affixed within the support frame, and a plurality of pin-holding blocks slidably mounted with respect to the support frame, to which the pins are threadedly fastened. A plurality of nuts are provided, one for each of the pin-holding blocks, threaded to the vertical threaded member and associated with the blocks such that turning one of the nuts with respect to the threaded member moves the block along the threaded member. Both the slider bars and the pin holding blocks are provided with locking means for locking them in position once they have been placed in the desired position.

Other objects and advantages of the invention will become apparent hereinafter.

DESCRIPTION OF THE PREFERRED EMBODIMENT

Figure 1:
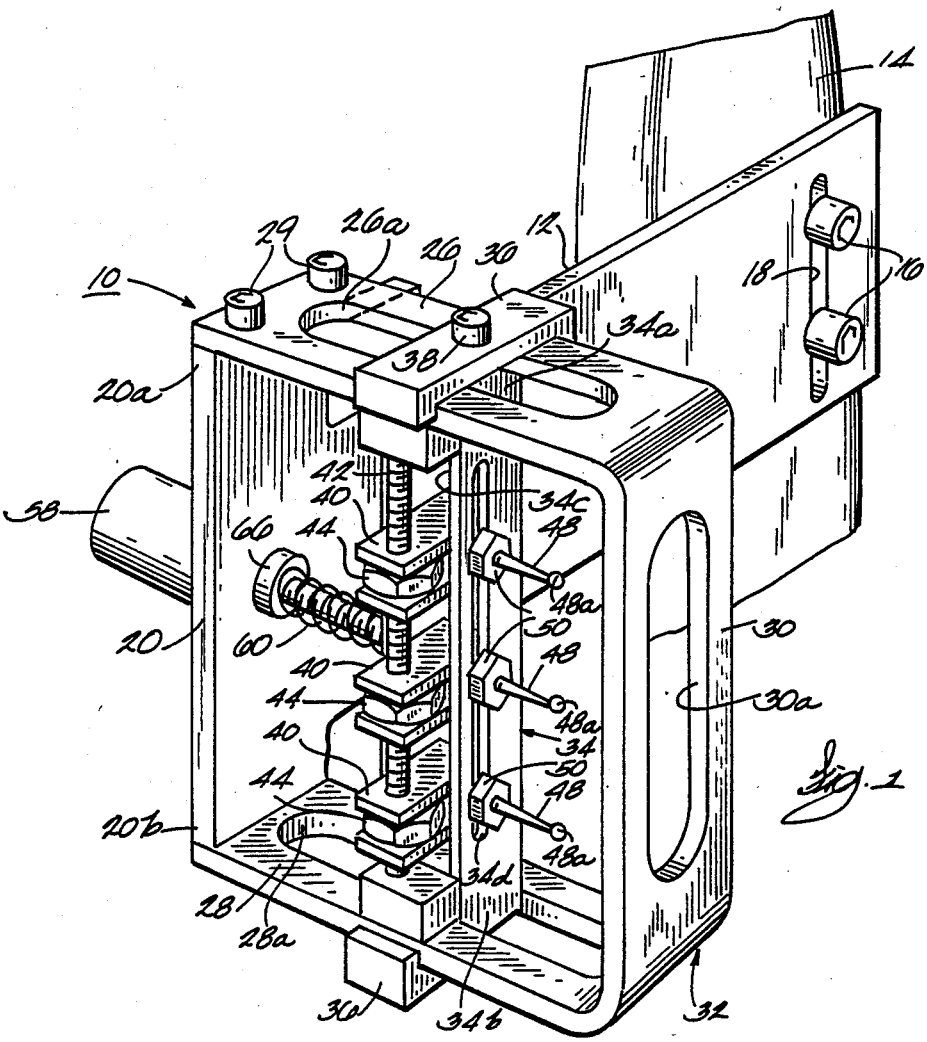
FIG. 1 is an isometric view of a bow sight constructed according to a preferred embodiment of the invention.
Figure 5:
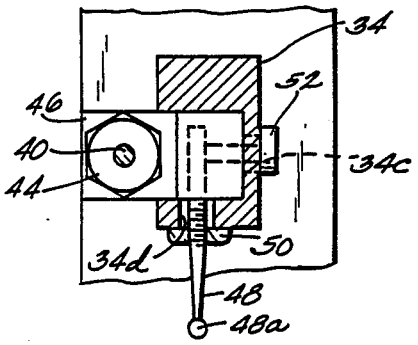
FIG. 5 is a fragmentary cross sectional view of the pin block portion of the apparatus shown in FIG. 2, taken along line 5—5 of FIG. 2.

Referring now to FIG. 1, there is shown a bow sight apparatus 10 constructed according to a preferred embodiment of the invention The apparatus 10 includes a mounting plate 12 removably attached to a bow stock 14 by suitable means such as screws 16. In one embodiment, the screws 16 pass through a substantially vertical slot 18 in the mounting plate 12 before being threaded into the bow stock 14. This slot 18 permits gross adjustment of the vertical position of the apparatus 10 with respect to the bow stock 14.

Figure 2:
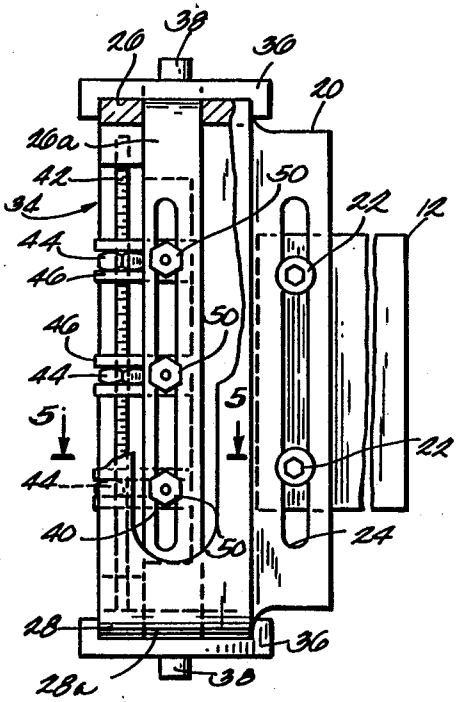
FIG. 2 is a side view of the bow sight shown in FIG. 1.

As can be seen by comparing FIGS. 1 and 2, the end of the mounting plate 12 opposite to that attached to the bow stock 14 is attached to a base plate 20. Again in the embodiment shown the attachment of the base plate 20 to the mounting plate 12 is by screws 22, which pass through a substantially vertical slot 24 in the mounting plate 12 and are threaded into the base plate 20, permitting gross adjustment of the vertical position of the apparatus 10 with respect to the bow stock 14. Combining the movement permitted by the slot 18 in the mounting plate 12 and the movement permitted by the slot 24 in the base plate 20 results in a substantial amount of permitted gross vertical movement of the apparatus 10 with respect to the bow stock 14.

As shown in the drawing figures generally, in one embodiment the base plate 20 is substantially vertically elongated, and has a top end **20*a* and a bottom end 20*b*. To each of respective ends 20*a* and 20*b* of base plate 20 is attached an upper slider bar 26 and a lower slider bar 28 respectively. As shown in the figures, this attachment is by screws 29. In the embodiment shown, the two slider bars 26 and 28 are integrally joined at their distal ends by a cross piece 30. There is thus provided a U-shaped slider plate 32 having two substantially horizontal legs 26 and 28, each leg having one end connected to or formed integrally with the substantially vertical cross piece 30, and each leg having its other end affixed to a respective end of base plate 20 by screws 29. This arrangement provides substantial strength, stability and rigidity advantages over an arrangement where the slider plates 26 and 28 are not connected at all at the ends opposite the ends connected to base plate 20. The strength, stability and rigidity of this arrangement is important when aiming a bow at a target some distance from the archer. As shown best in FIG. 1, the cross piece 30 may have a large opening 30a** centered therein to substantially reduce weight without sacrificing a significant amount of the strength, stability and rigidity referred to above.

Slidably mounted between the slider bars 26 and 28 is a pin-holding means, pin holder 34. In the embodiment shown, the pin holder 34 is elongated vertically, having an upper end 34a slidably attached to upper slider bar 26 and a lower end 34b slidably attached to lower slider bar 28. While any suitable means may be provided for enabling the pin holder 34 to slide horizontally along the slider bars 26 and 28, the means shown in the figures includes a clamping bracket 36 secured axially to each end 34a and 34b of the pin holder 34 on the opposite side of slider bars 26 and 28, such that the slider bars are clamped between the clamping bracket and the respective pin holder end. In the embodiment shown, each clamping bracket 36 is attached to a respective end 34a or 34b by a screw 38, which passes through the bracket and through a slot 26a and 28a formed substantially for the length of the respective slider bar 26 and 28, finally being threaded directly into the respective end of pin holder 34. Clamping bracket 36 and screw 38 also act as locking means to lock the pin holder 34, preventing inadvertent movement of the pin holder with respect to slider bars 26 and 28. This locking is accomplished by tightening down the screw 38. Hence when screw 38 is loosened, relative sliding motion is permitted.

As indicated above, pin holder 34 is vertically elongated, and in effect acts as a support frame for the pin mounting blocks 40, referred to in more detail below. As shown best in FIG. 3, a substantially vertical slot 34c is formed in the front face of pin holder 34, centered and just short of the full length of the pin holder, reaching within a short distance of each end 34a and 34b of the pin holder. The depth of the slot 34c is the entire depth of the pin holder 34, so that it also appears in the back face of the pin holder, as shown best in FIG. 4, although the width and length of the slot may vary slightly over its depth.

A number of pin mounting blocks 40 are mounted in the slot 34c so as to be vertically slidable along the slot. The number may vary depending upon the level or quality of the sight and the desires of the archer. The apparatus 10 shown in the drawing figures includes three such blocks, although it is not unusual to employ four or some other suitable number of blocks. A threaded rod 42 slightly longer than slot 34c is affixed substantially vertically to the front face of the pin holder 34, positioned in front of the slot. Each of the pin mounting blocks 40 is connected to the threaded rod 42 by means of a nut 44 threaded onto the rod, and captured between two flanges 46 extending outward from the front of the respective block. Each of the flanges 46 includes an aperture sized to just admit the threaded rod 42. Hence movement of a particular pin mounting block 40 along the threaded rod 42, and thus along the slot 34c, is accomplished by turning the respective nut 44.

A substantially vertically oriented side 35 slot 34d is also formed in the side surface of the pin holder 34 facing away from the base plate 20. Into this side slot 34d are inserted a number of sight pins 48, the same number of sight pins as blocks 40. Each of the sight pins 48 is threaded into a respective one of the blocks 40, and each terminates in a sight ball 48a, for permitting the archer good sighting capabilities. As is well known in the art, each sight ball may be phosphorescent or otherwise luminescent to further aid the archer in sighting. The fact that each sight pin 48 is threaded into the respective block 40 provides the sight pins with the capability of individually moving the respective sight ball 48a axially, toward or away from the block, and with respect to each other. Each sight pin 48 is then provided with a lock nut 50 as a means for locking the sight pin in place once its lateral position with respect to the other sight pins is established to the satisfaction of the archer. That is, once the particular sight pin is positioned with respect to the block, the lock nut 50 is tightened to prevent the sight pin from moving until the nut is again loosened.

Means for locking the pin mounting blocks 40 with respect to the threaded rod 42 is also provided. As shown best in FIG. 4, the locking means include set screws 52 which are inserted through the rear of the slot 34c and threaded into the respective block 40. Then when a set screw 52 is loosened, movement of the respective block 40 within slot 34c is possible, and when tightened, such movement is prevented.

Figure 4:
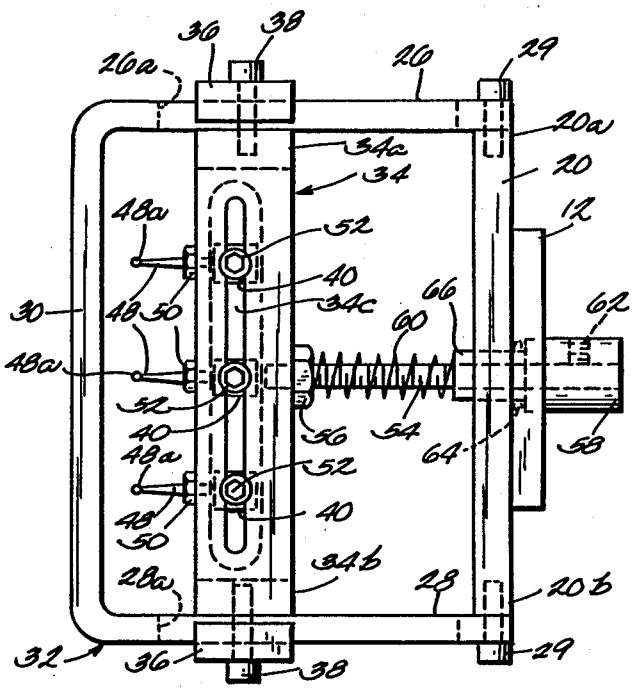
FIG. 4 is a rear view of the bow sight shown in FIG. 1.
Figure 3:
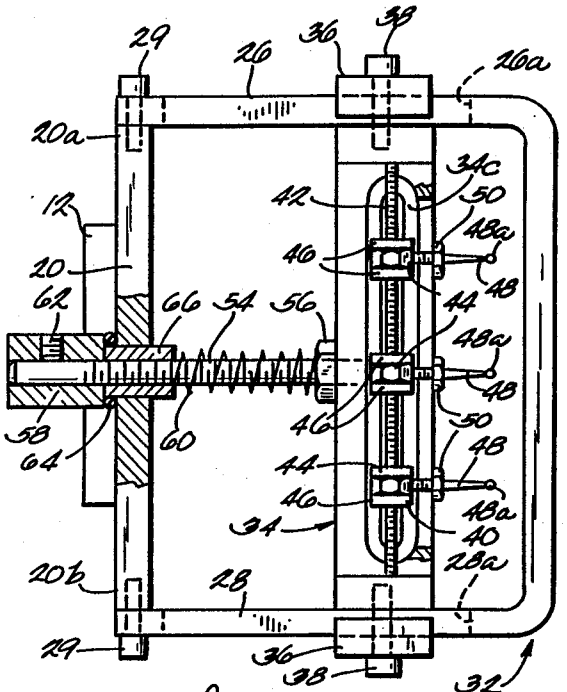
FIG. 3 is a front view of the bow sight shown in FIG. 1, with the slider bar in a different position than that shown in FIG. 1.

Finally, a means is provided for moving the entire pin holder 34 laterally with respect to the slider bars 26 and 28, and with respect to the base plate 20. In the embodiment shown in FIGS. 1, 3 and 4, this means includes a threaded rod 54 inserted substantially horizontally through the base plate 20 and anchored in the pin holder 34, at about the center of both the base plate and the pin holder. The rod 54 may be anchored to the pin holder 34 by any suitable means, and the anchoring means shown is the rod being threaded into the nearest surface of the pin holder 34, and held there by a lock nut 56. From the pin holder 34, the rod 54 passes through and projects outward beyond the base plate 20. There is a nut, in effect an adjustment knob 58, threaded onto the projecting end of the rod 54, which bears on the opposite side of the base plate 20. Since rod 54 is freely slidable with respect to the base plate 20, a spring 60 or other biasing means is provided to bias pin holder 34 and base plate 20 away from each other. As shown in FIGS. 1, 3 and 4, spring 60 is a coil spring encircling the rod 54 and biasing the pin holder 34 and the base plate 20 apart. In operation, then, turning the adjustment knob 58 in one direction results in lateral movement of the pin holder 34, and hence the sight balls 48a, in a certain direction, and turning the knob in the opposite direction results in lateral movement of the sight balls in the opposite direction.

To facilitate prevention of undesired movement of the adjustment knob 58, means for locking the knob with respect to the rod 54 is provided. In the embodiment shown, this locking means is a set screw 62 in the knob 58, which bears on the rod 54 when tightened. Further, there may be provided an O-ring 64, as shown in FIGS. 3 and 4, between the adjustment knob 58 and the base plate 20 to make the relative movement between the two pieces smoother.

To facilitate the sliding movement of the rod 54 with respect to the base plate 20, a bushing 66 may be provided in the opening of the base plate through which the rod 54 passes, and through which bushing the rod more easily slides. Depending upon the relative sizes of the bushing 66, coil spring 60 and lock nut 56, the spring may bear on the nut and bushing, rather than the pin holder 34 and base plate 20 respectively.

While the apparatus hereinbefore described is effectively adapted to fulfill the aforesaid objects, it is to be understood that the invention is not intended to be limited to the specific preferred embodiment of archery bow sight with ganged lateral pin movement set forth above. Rather, it is to be taken as including all reasonable equivalents within the scope of the following claims.

I claim:

1. An archery bow sight mechanism for mounting to a bow stock, comprising:

base means for connection to said bow stock, and having an upper end and a lower end;

a pair of slider bars, one affixed to said upper end and one affixed to said lower end of said base means;

pin holding means, having two ends, each end slidably mounted to a respective one of said slider bars;

a plurality of sight pins movably connected to said pin holding means;

a lateral adjustment rod affixed to said pin holding means; and moving means for moving said lateral adjustment rod with respect to said base means, such that said sight pins are moved laterally with respect to said bow stock, but are not moved at all with respect to each other.

2. A mechanism as recited in claim 1 wherein said lateral adjustment rod projects through said base means and is threaded, and wherein said moving means includes a nut rotatably secured with respect to said base means and threaded on said lateral adjustment rod, such that said rod is moved laterally with respect to said bow stock by turning said nut on said lateral adjustment rod.

3. A mechanism as recited in claim 1 wherein said lateral adjustment rod projects through said base means and is threaded, and wherein said moving means includes a nut positioned on the opposite side of said base means from said pin holding means and bearing on said base means.

4. A mechanism as recited in claim 2 or claim 3 further comprising biasing means for biasing said pin holding means and said base means away from each other.

5. A mechanism as recited in claim 4 wherein said biasing means includes spring means positioned between said pin holding means and said base means.

6. A mechanism as recited in claim 5 wherein said spring means includes a coil spring positioned about said lateral adjustment rod, between said pin holding means and said base means.

7. A mechanism as recited in claim 1 wherein said pin holding means comprises:

a support frame;

a threaded member substantially vertically affixed therein;

a plurality of pin mounting blocks slidably mounted with respect to said support frame, to which blocks said pins are threadedly fastened; and a plurality of nuts, one for each of said pin mounting blocks, attached to said threaded member and associated with said blocks such that turning one of said nuts with respect to said threaded member moves said block along said threaded member.

8. A mechanism as recited in claim 7 wherein said pin-holding means further comprises block locking means for locking said pin mounting block with respect to said threaded member.

9. A mechanism as recited in claim 1 further comprising slider locking means for locking said pin-holding means with respect to said slider bars.

10. A bow sight for associating a plurality of sight pins with a bow stock, said sight comprising:

a substantially vertical base plate attached to said bow stock, and having an upper end and a lower end;

a U-shaped slider plate, having two substantially horizontal legs, each leg having one end connected to or formed integrally with a substantially vertical cross-piece, and each leg having another end affixed to a respective end of said base plate;

a substantially vertical pin holder having a top end and a bottom end, slidably connected at each end to one of said legs of said slider plate, and having said sight pins connected substantially normal thereto; and sliding means for sliding said pin holder laterally along said slider plate.

11. A bow sight as recited in claim 10 wherein said sliding means comprises a threaded rod affixed to said pin holder and protruding laterally through said base plate, and a nut threaded onto said rod in contact with said base plate, such that turning said nut causes said rod, and hence said pin holder, to slide along said slider plate.

12. A bow sight as recited in claim 10 wherein said sliding means comprises a threaded rod affixed to said pin holder and protruding laterally through said base plate, and a nut threaded onto said rod and positioned on the opposite side of said base plate from said pin holder, such that turning said nut causes said rod, and hence said pin holder, to slide along said slider plate.

13. A bow sight as recited in claim 12 further comprising biasing means for biasing said pin holder and said base plate away from each other.

14. A bow sight as recited in claim 13 wherein said biasing means includes a coil spring coiled about said threaded rod and bearing on said pin holder and said base plate.

15. A bow sight as recited in claim 14 further comprising means for locking said pin holder in a predetermined position with along said slider plate.

16. A bow sight as recited in claim 10 wherein said pin holder includes a plurality of pin mounting blocks, to which are attached said sight pins, said pin mounting blocks being movable along said bar by block moving means.

17. A bow sight as recited in claim 16 wherein said block moving means includes a substantially vertical threaded rod affixed to said pin holder, and a plurality of nuts, one for each of said pin mounting blocks, each threaded onto said threaded rod and associated with a respective one of said blocks, such that turning one of said nuts results in movement of said respective one of said blocks along said rod.

18. A bow sight as recited in claim 17 further comprising means for locking each of said pin mounting blocks so as to prevent their movement with respect to said pin holder.

* * * * *